US005961086A

United States Patent [19]

Moore et al.

[11] Patent Number: 5,961,086

[45] Date of Patent: Oct. 5, 1999

[54] HANDS-FREE GRIPPING DEVICE FOR CONTAINERS

[75] Inventors: Patrick Q. Moore, Gilroy; Stephen E. Little, Cupertino, both of Calif.

[73] Assignee: Beckman Coulter, Inc., Fullerton, Calif.

[21] Appl. No.: 09/067,484

[22] Filed: Apr. 27, 1998

[51] Int. Cl.[6] ..... A47F 5/00

[52] U.S. Cl. ..... 248/314

[58] Field of Search ..... 248/314, 310, 248/311.2, 105, 102; 206/315.9

[56] References Cited

U.S. PATENT DOCUMENTS

| | | | |
|---|---|---|---|
| 1,475,905 | 11/1923 | Van Horsen | 248/311.2 X |
| 2,559,353 | 7/1951 | Fisch | 248/310 X |
| 3,945,491 | 3/1976 | Lindenbaum | 248/310 X |
| 5,600,927 | 2/1997 | Kennon | 52/301 |
| 5,657,897 | 8/1997 | Schwartzburg | 220/669 |

*Primary Examiner*—Ramon O. Ramirez
*Attorney, Agent, or Firm*—William H. May; Paul R. Harder; Thomas Schneck

[57] ABSTRACT

A hands-free gripping device which holds generally cylindrical containers, particularly labware, securely and prevents the container from turning while either opening or closing it. The gripping device features internal deformable ribbing, which secures the container by canting slightly when the container is turned thereby wedging the container in place. This action resists rotation in either direction, making a single device practical for both opening and closing. The device can be mounted on any flat surface and acts as a "third hand" to allow the user to use both hands or to use a single hand to grasp securely the closure being removed or secured from the container. The gripping device facilitates assembly or disassembly of labware devices needing application of torque.

18 Claims, 3 Drawing Sheets

*Fig.* 1

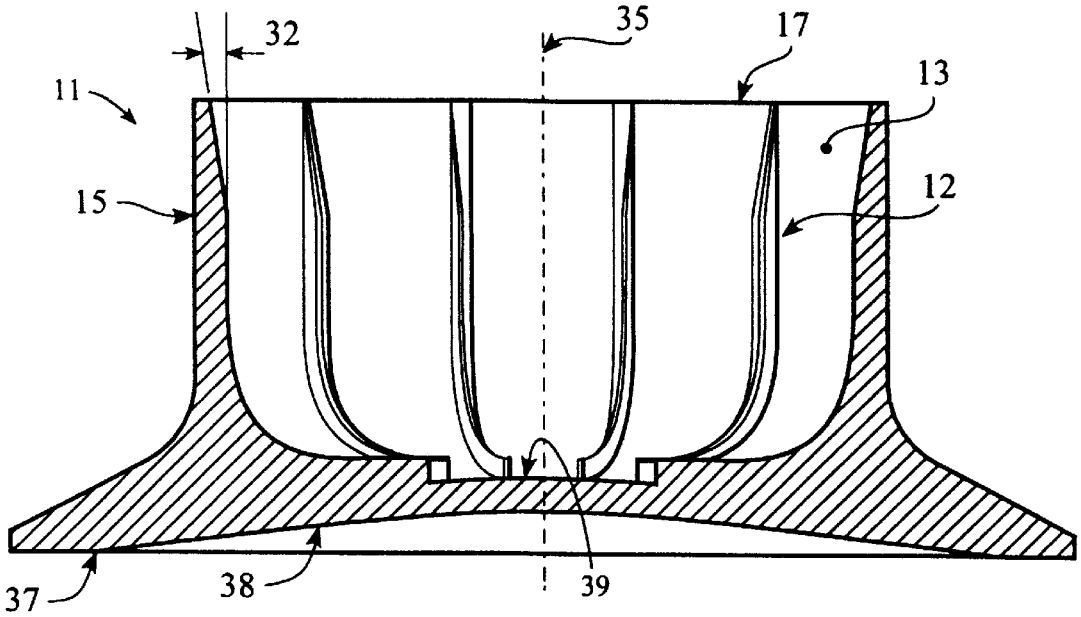
*Fig.* 4
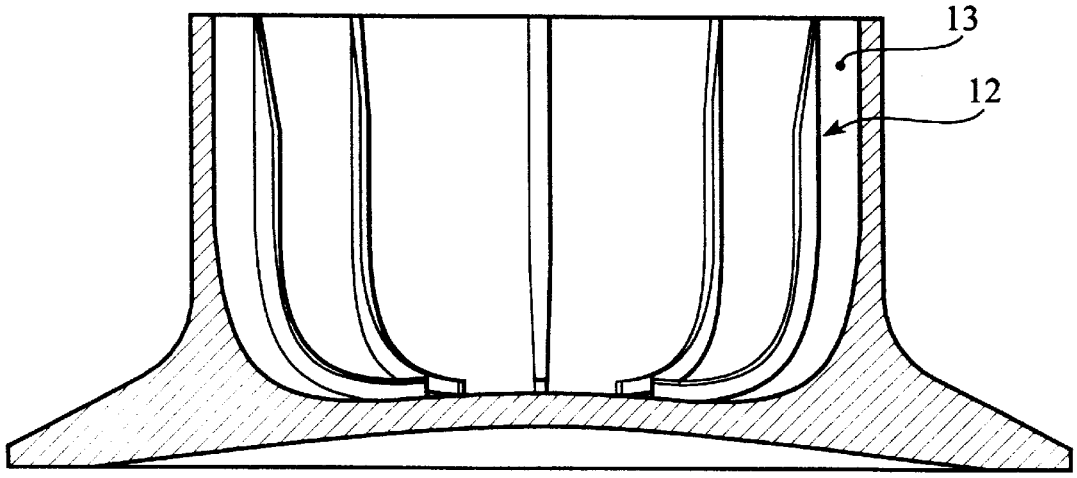
*Fig.* 5

HANDS-FREE GRIPPING DEVICE FOR CONTAINERS

TECHNICAL FIELD

The invention relates to a container support device, and more particularly to a device for gripping and holding a container securely while the container is being opened or closed.

BACKGROUND ART

Centrifuges are commonly used in medical and biological industries for separating and purifying materials of differing densities, such as viruses, bacteria, cells and proteins. A centrifuge includes a rotor and a container to support a sample undergoing centrifugation. The rotor is designed to hold the sample container while it spins up to tens of thousands of revolutions per minute. To avoid spillage, evaporation, or aerosoling of the sample, a cover is placed onto the container so as to provide a fluid-tight seal therebetween.

The containers that are used are generally quite large. On average, the containers are about 3¾ in. in diameter, 8–9 inches tall, and approximately one liter in volume. The cap/closure for such a container is over four inches in diameter. Because of the large size of the container and of the cap/closure, it is difficult for a lab technician to open and close the labware container. Additionally, because of the need to avoid leakage and evaporation, the containers are usually required to be tightened to a specified tightening torque, usually about 30 in.-lbs. Again, because of the large size of the container, it is difficult for lab technicians to hold the container and turn the large closure to seal the container at the required tightening torque or to open a closure that has been sealed at that torque. What is needed is a device that will provide a firm grip on the labware container to assist lab technicians in opening and closing the container.

Various container holders and grippers are known in the prior art. U.S. Pat. No. 5,657,897 to Schwartzburg discloses a beverage container for accommodating drink cup holders which vary in size. The container has flexible fins on the outside of the container which are offset from a radial orientation to contact the drink holder wall with enough force to hold the cup in a stable position. U.S. Pat. No. 5,600,927 to Kennon discloses a strapped rebar end protector with an elastic strap. The protector has vertical support ribs in the protector interior to grip the rebar, but the elastic strap is needed to place the protector under enough tension to securely keep the protector in place.

SUMMARY OF THE INVENTION

The invention is a hands-free gripping device which holds cylindrical containers, particularly labware, securely and prevents the container or labware from turning about its cylindrical axis while either opening or closing the labware. The gripping device of the present invention features internal ribbing, which secures the container and accommodates and resists rotation in either direction, making a single device practical for both opening and closing. The ribs are flexible members circumferentially disposed parallel to the cylindrical axis about the bowl-shaped interior of the holder, into which the container is nested with a snug fit. The snug fit slightly deforms the flexible members causing a wedge effect when the container or labware is turned. Further turning is resisted by the ribbing. The device can be mounted on any flat or textured work surface and this allows the user to either use both hands or to use a tool to grasp securely the closure being removed or secured from the container. The gripping device of the present invention facilitates assembly and disassembly of labware devices needing application of torque.

BRIEF DESCRIPTION OF THE DRAWINGS

FIG. 4 is a sectional view of the gripping device of the present invention.

FIG. 5 is a cross-sectional view of the gripping device of the present invention.

FIG. 6 is a top view of a section of the gripping device of the present invention showing the internal ribs being in contact with a labware container.

BEST MODE FOR CARRYING OUT THE INVENTION

Figure 1:
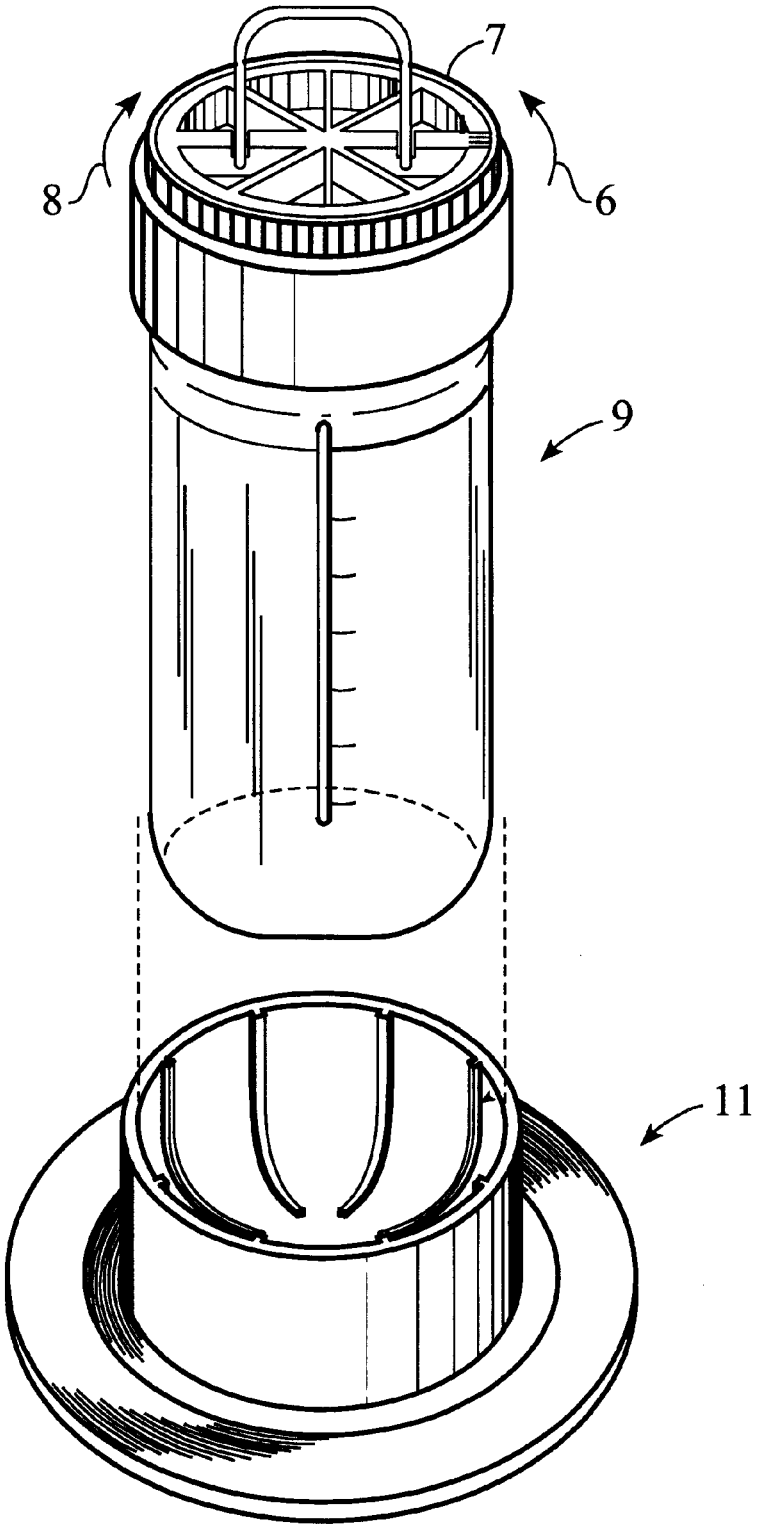
FIG. 1 is a perspective view showing the relative position of a labware container when inserted into the gripping device of the present invention.

FIG. 1 shows the relative position of a labware container 9 when it is inserted into the bowl portion of base 11 of the gripping device of the present invention. The container 9 is inserted in the base 11 of the gripping device and the gripping device provides a secure hold on the container 9 while the lid 7 of the container is opened or closed. The gripping device maintains its hold on the container 9, allowing the lid 7 to be turned in either a clockwise 8 or counter-clockwise 6 direction.

Figure 2:
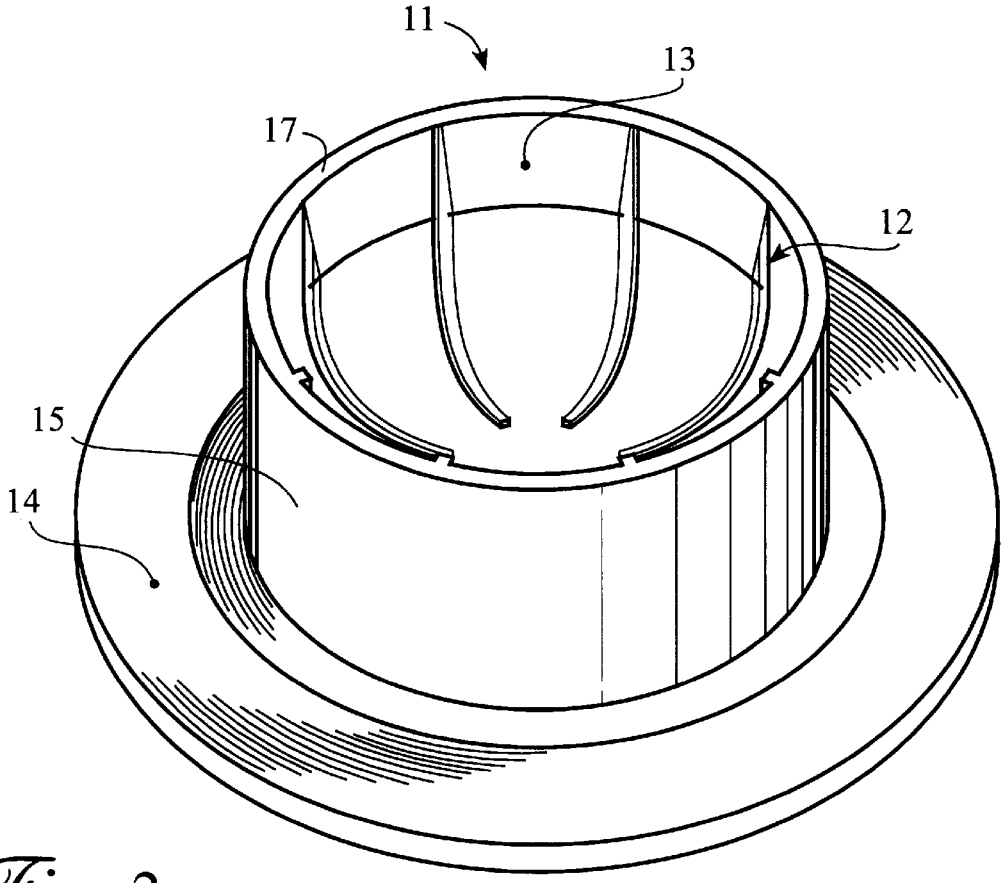
FIG. 2 is a perspective view of the gripping device of the present invention.

Referring to FIG. 2, the gripping device consists of a cylindrical base 11 having an outer surface 15 and an inner surface 13 defining a bowl. The top surface 17 of the base is open, such that a labware container may be inserted into the base 11. The height of the base 11 is dependent on the size of the radius of the container 9. The height of the base 11 should be sufficient to allow enough of the container 9 to be contacted by ribs 12 of the gripping device such that a strong grip is provided, but not so much as to restrict the vertical extraction or insertion of the container. For example, for a one liter size container, the base should be effective by rib contact along ¼ to ⅕ of the length of the container. Around the bottom edge of the base 11 is a footing 14 which provides stability to the base and can be optionally used as a flange for mounting purposes. The plurality of internal ribs 12 are concentrically arranged around the inner surface 13 of the bowl portion of the base, parallel to the cylindrical axis thereof. The number of internal ribs 12 is dependent upon the degree of grip required, which is a function of the amount of torque required to open or close the labware container. The number of internal ribs 12 provided should be enough so that the gripping device holds the labware container 9 tight enough for a person using the device to close the lid 7 to the specified tightening torque, but not so tight such that the person would be allowed to tighten the lid 7 beyond the specified torque value. Additionally, if there are too many ribs 12, it becomes difficult to insert the container 9 into or remove it from the device.

Figure 3:
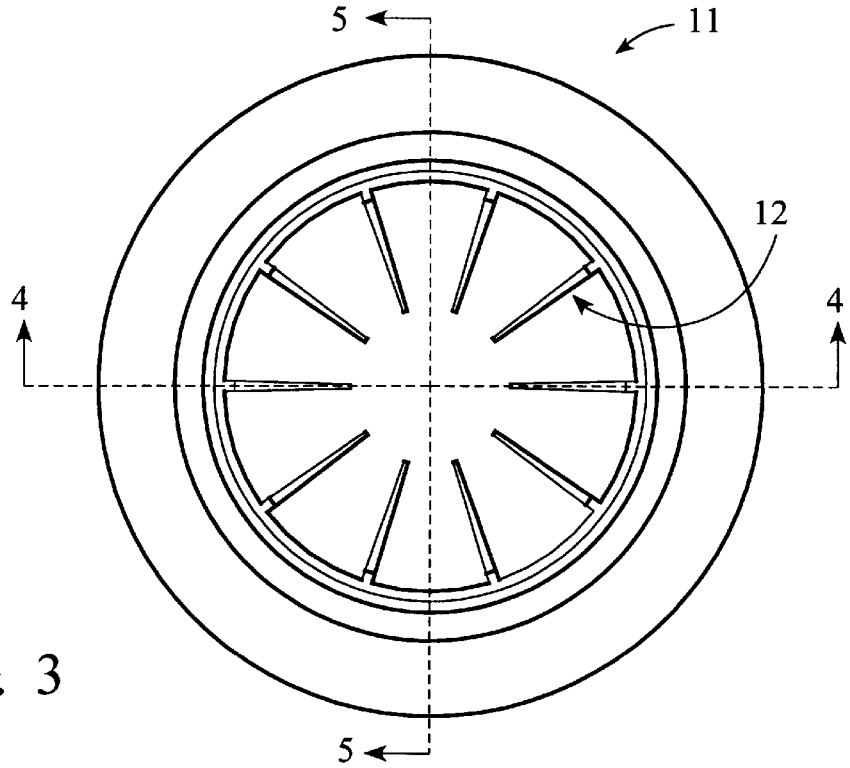
FIG. 3 is a top view of the gripping device of the present invention, also showing the sectional cuts made to produce FIGS. 4 and 5.

FIG. 3 illustrates the circumferential positioning of the internal ribs 12 around the base 11. In FIG. 3, the ribs are positioned in a symmetrical arrangement around the base.

The base 11 and the internal ribs 12 can be made of rubber, urethane, or of any number of elastomeric or rubber compounds. In the preferred embodiment, the base 11 and internal ribs 12 are formed as a one-piece molded device and are made of flexible elastomers or urethanes because of their ease of manufacture and greater latitude in tolerancing. However, the base 11 could be made out of a structurally rigid material, such as plastic, with pliable or deformable internal ribs 12 added.

FIG. 4 is a sectional view of the gripping device shown in FIG. 3 taken through the reference plane 4—4, as noted in FIG. 3. In FIG. 4, it can be seen that the base li has a circular nature about the vertical centerline axis 35. It can also be seen in this view that the ribs 12 are an integral part of the structure of the inner surface 13 of the base 11. The outer surface 15 sidewall can be perpendicular to the base bottom 37 or tapered, as shown in FIG. 4. The base bottom 37 can be a contiguous flat surface or, as shown in FIG. 4, can have a concave suction cup feature 38 that can be used to secure the gripping device to a surface. The gripping device can be mounted on any flat or irregular instrument or laboratory surface. The device can be mounted by self sticking using the suction cup feature 38 noted above or by using some form of adhesive or mechanical fastening means.

The internal ribs 12 each have a taper 32 starting at the top surface 17. The tapering of the internal ribs 12 allows for easier insertion of the labware container into the gripping device. By varying the degree of insertion taper 32 on the internal ribs 12, the insertion force that is needed to insert the container into the gripper will vary. To accommodate slight manufacturing variations in diameter, outer surface wall 15 will flex slightly to still allow easy insertion. FIG. 5 is a cross sectional view of the gripping device shown in FIG. 3 taken through the reference plane 5—5, as noted in FIG. 3. The main purpose of FIG. 5 is to illustrate the profile of the internal ribs 12 as they are arranged on the inner surface 13 of the gripping device. Referring to FIGS. 4 and 5, the internal ribs 12 may extend all the way from the top surface 17 to the bottom inner surface 39. However, several variations on the size and shape of the internal ribs 12 are possible. The object is to have an alignment that provides a good grip without hindering the ability to insert or remove the container. In order to avoid having to rely on the user to push down on the container while opening or closing the lid, it is necessary to have a portion of the internal ribs 12 on the bottom inner surface 39.

FIG. 6 is a top view of a section of the gripping device showing the internal ribs 12 being in contact with the labware container 9. This view illustrates a key feature of the invention, the gripping effect of the internal ribs 12 on the container 9 when the container 9 is rotated clockwise or counterclockwise. If the labware container 9 is rotated clockwise or counterclockwise (as shown in FIG. 6) the rib will extend inwardly, canting about the central axis to present a taller profile, like a wedge, thereby jamming up tighter against the labware container 9. This taller profile is illustrated by the dashed line representation of the canted ribs 53. This wedge action, when it occurs on all of the internal ribs, creates a smaller circular profile, hence grabbing the container 9 tighter. This gripping action can be reversed by simply reversing the direction of rotation until the internal ribs are back at their steady state profile (i.e. the canted rib 53 returns to its original position, rib 12.) As can be seen, the gripping action is self-activating by merely rotating the container.

The internal ribbing can conform to the shape of the container, but it does not need to conform to the shape of the container. As described above, there is a correspondence between the internal diameter of the gripping device at the rib tips and the outer diameter of the container. As long as that relationship is closely followed, gripping devices can be produced for many different sizes of containers. Again, the internal ribs 12 can have numerous shapes so long as, when the ribs are flexed sideways by the container 9 contacting the surface of the ribs, through the rotating motion of tightening or loosening the caps, the movement of the ribs serves to narrow the circular diameter defined by the tops of the ribs at a relaxed state by creating a wedge action. Variations can also be made to the rib configuration, as well as the quantity of ribs, however the basic principle of operation remains the same. It is also possible to make the gripping device to have a conical internal shape, rather than cylindrical, in order to accommodate a wide variety of sizes of containers and the term "bowl-shape is intended to encompass such conical structures. However, this would necessitate a substantial increase in the height of the base 11, which could make the device cumbersome to work with. However, this arrangement would allow interchangeability in the sizes of the containers without having to use gripping devices of different sizes.

The apparatus of the present invention allows lab technicians to open containers single handedly, allowing a free hand to accomplish other tasks. A single gripping device can be used for either opening or closing the container, the device works for either direction.

There are multiple methods of mounting, e.g. self-adhering via suction or by some form of self stick adhesive, and the device can be mounted on virtually any surface, regardless of surface roughness. Also, there are no additional tools to operate in the use of the device. The flexible grip allows the container to be moved off of the vertical axis and still remain securely in the grasp of the device. Finally, it is flexible to allow for standard size variation of the container to be opened.

We claim:

1. A device for gripping generally cylindrical canisters or labware, the device comprising:

a tubular cylindrical base having a bottom surface, a top, an outer surface and an inner surface and having a central axis; and a plurality of flexible tapered ribs disposed on the inner surface of the base projecting inwardly therefrom, the ribs being arranged circumferentially around the central axis of the inner surface of the base, each rib having a tip adapted to contact an item that is inserted into the device.

2. The device of claim 1 wherein the inner surface is bowl-shaped.

3. The device of claim 1, wherein the base and the ribs are made of an elastomeric or rubber compound material.

4. A device for gripping generally cylindrical canisters or labware, the device comprising:

a tubular cylindrical base having a bottom surface, a top, an outer surface and an inner surface and having a central axis; and a plurality of flexible tapered ribs disposed on the inner surface of the base projecting inwardly therefrom, the ribs being arranged circumferentially around the central axis of the inner surface of the base, each of the ribs having a taper such that a portion of the rib at the top of the base is thinner than a portion of the rib near the bottom surface of the base.

5. A device for gripping generally cylindrical canisters or labware, the device comprising:

a tubular cylindrical base having a bottom surface, a top, an outer surface and an inner surface and having a central axis; and a plurality of flexible tapered ribs disposed on the inner surface of the base projecting inwardly therefrom, the ribs being arranged circumferentially around the central axis of the inner surface of the base, each rib having a flat tip extending inwardly canting about the central axis upon an application of a rotational force thereon about the axis, each rib having a greater inward extent when canted than when relaxed.

6. A device for gripping generally cylindrical canisters or labware, the device comprising:

a tubular cylindrical base having a bottom surface, a top, an outer surface and an inner surface and having a central axis; and a plurality of flexible tapered ribs disposed on the inner surface of the base projecting inwardly therefrom, the ribs being arranged circumferentially around the central axis of the inner surface of the base, each rib having a length extending from an edge of the top surface to a location on a bottom portion of the inner surface.

7. A device for gripping generally cylindrical canisters or labware, the device comprising:

a tubular cylindrical base having a bottom surface, a top, an outer surface and an inner surface and having a central axis; and a plurality of flexible tapered ribs disposed on the inner surface of the base projecting inwardly therefrom, the ribs being arranged circumferentially around the central axis of the inner surface of the base, wherein the bottom surface of the base extends outward such that the bottom surface is wider than the top of the base, forming a mounting flange.

8. A device for gripping generally cylindrical canisters or labware, the device comprising:

a tubular cylindrical base having a bottom surface, a top, an outer surface and an inner surface and having a central axis; and a plurality of flexible tapered ribs disposed on the inner surface of the base projecting inwardly therefrom, the ribs being arranged circumferentially around the central axis of the inner surface of the base, wherein the bottom surface of the base is formed in a concave shape to form a suction cup for mounting.

9. A device for gripping generally cylindrical canisters or labware, the device comprising:

a base having a bottom surface, a top, a cylindrical outer surface and a bowl-shaped inner surface, the bottom surface of the base extending outward such that the bottom surface is wider than the top; and a plurality of flexible tapered ribs disposed on the bowl-shaped inner surface of the base projecting inwardly therefrom, the ribs being arranged circumferentially around the inner surface of the base, each rib having an inwardly extending tip deformable into a wedge-line shape upon insertion of a cylindrical canister or labware into the bowl shaped inner surface.

10. The device of claim 9, wherein the base and the ribs are made of an elastomeric or rubber compound material.

11. The device of claim 9, wherein each of the ribs have a taper such that a portion of the rib at the top of the base is thinner than a portion of the rib near the bottom surface of the base.

12. The device of claim 9, wherein each rib has a length extending from an edge of the top surface to a location on a bottom portion of the inner surface.

13. The device of claim 9, wherein the bottom surface is formed in a concave shape to form a suction cup for mounting.

14. A device for gripping generally cylindrical canisters or labware, the device comprising:

a cylindrical base having a bottom surface, a top, an outer surface and a bowl-shaped inner surface, the bottom surface of the base extending outward such that the bottom surface is wider than the top; and a plurality of flexible tapered ribs on the bowl-shaped inner surface of the base projecting inwardly therefrom, the ribs being arranged circumferentially around said inner surface, each of the ribs having a taper such that a portion of the rib at the top of the base is thinner than a portion of the rib near the bottom surface of the base, the ribs having an inwardly extending extent adapted to correspond to the diameter of a cylindrical container or labware to be gripped.

15. The device of claim 14, wherein the base and the ribs are made of an elastomeric or rubber compound material.

16. The device of claim 14, wherein each rib has a length extending from the top to a location near the bottom surface.

17. The device of claim 14, wherein the bottom surface is formed in a concave shape to form a suction cup for mounting.

18. The device of claim 14, wherein the bottom surface of the base is formed in a contiguous flat surface.

* * * * *

UNITED STATES PATENT AND TRADEMARK OFFICE

CERTIFICATE OF CORRECTION

PATENT NO. : 5,961,086
DATED : October 5, 1999
INVENTOR(S) : Patrick Q. Moore et al It is certified that error appears in the above-identified patent and that said Letters Patent is hereby corrected as shown below:

After sheet 3 of 3, add Fig. 6, as attached.

Signed and Sealed this

Fourteenth Day of August, 2001

Nicholas P. Godici

*Attest:*

*Attesting Officer*

NICHOLAS P. GODICI
*Acting Director of the United States Patent and Trademark Office*

BEC-071 4/4
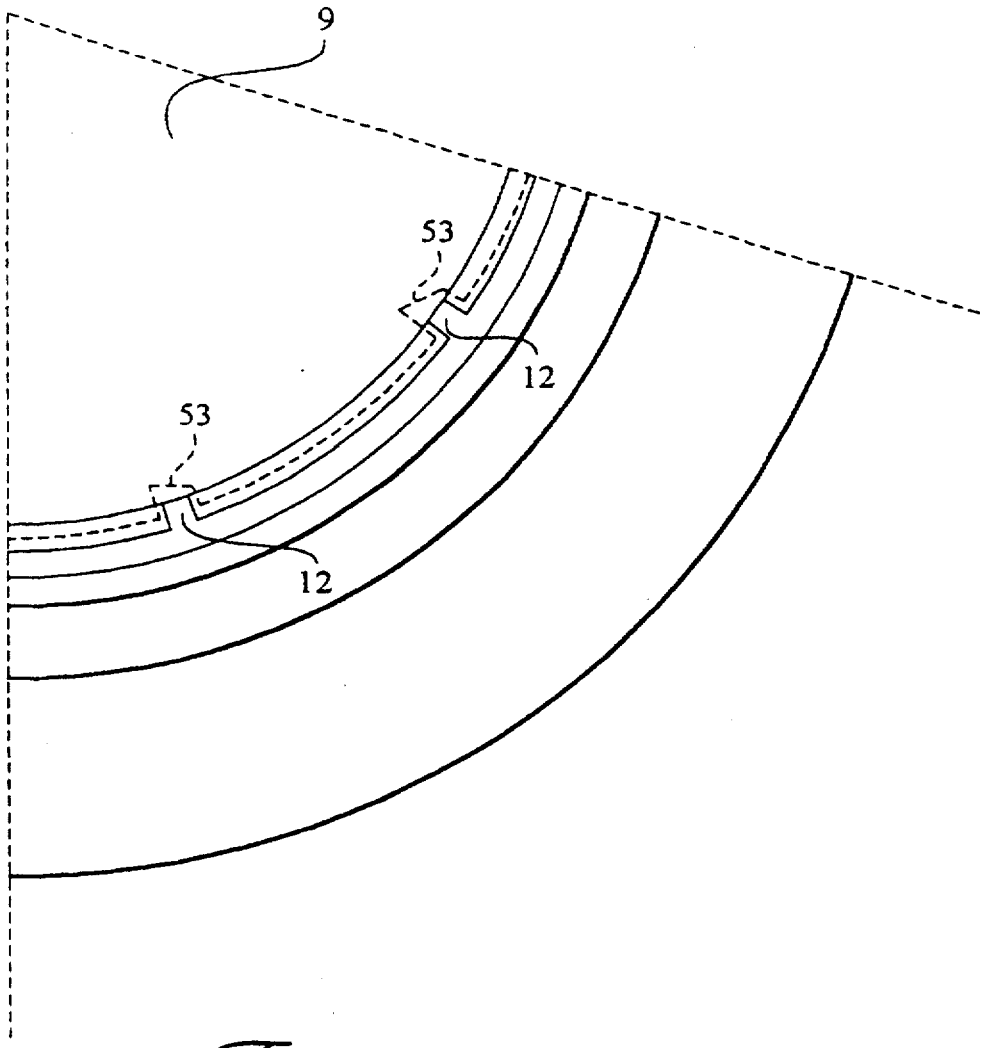
*Fig.* 6